United States Patent [19]

Klier

[11] Patent Number: 5,066,894

[45] Date of Patent: Nov. 19, 1991

[54] ELECTRONIC BALLAST

[75] Inventor: Juergen Klier, Traunreut, Fed. Rep. of Germany

[73] Assignee: Siemens Aktiengesellschaft, Munich, Fed. Rep. of Germany

[21] Appl. No.: 592,125

[22] Filed: Oct. 3, 1990

[30] Foreign Application Priority Data

Oct. 9, 1989 [EP] European Pat. Off. ..... 89118713

[51] Int. Cl.[5] ..... H05B 37/02

[52] U.S. Cl. ..... 315/224; 315/209 R; 315/244; 315/287; 315/307

[58] Field of Search ..... 315/244, 209 R, 287, 315/307

[56] References Cited

U.S. PATENT DOCUMENTS

| | | | |
|---|---|---|---|
| 3,989,796 | 11/1976 | Tabor | 315/291 |
| 3,999,100 | 12/1976 | Dendy et al. | 315/308 |
| 4,628,230 | 12/1986 | Krokaugger | 315/307 |
| 4,959,591 | 9/1990 | Hirschmann | 315/209 |

FOREIGN PATENT DOCUMENTS

| | | |
|---|---|---|
| 0127101 | 12/1984 | European Pat. Off. . |
| 2544364 | 12/1976 | Fed. Rep. of Germany . |
| 3709004 | 9/1988 | Fed. Rep. of Germany . |

*Primary Examiner*—Eugene R. LaRoche
*Assistant Examiner*—R. Ratliff
*Attorney, Agent, or Firm*—Hill, Van Santen, Steadman & Simpson

[57] ABSTRACT

In electronic ballast having inverter rectifiers for fluorescent lamps, a regulation of the lamp current or of the lamp power is usually used in order to stabilize the lighting current independently of tolerances of the electrical properties of the fluorescent lamp or their aging phenomena. When such a regulation is simultaneously utilized for dimming the fluorescent lamp, difficulties arise at the lower limit of the dimming range at, for example, 1% of the nominal light power. The range of brightness at the lower limit is regulated on the basis of an additional regulation, dependent on the discharge resistance of the fluorescent lamp. An auxiliary measured quantity resulting therefrom is superimposed on the actuating quantity of the regulator that results from a reference/actual value comparison of the current or power regulation for the purpose of stabilizing the lamp current.

9 Claims, 2 Drawing Sheets

R2
R3
Uzw.
SUMMING ELEMENT
SW
HMG
RAG
SR
IW
RR
REGULATOR
WR
INVERSE RECTIFIER
O
OSCILLATOR
C1
R1
T1
T2
L1
LL
C2
A
B
D
IW
LAMP CURRENT OR POWER DETECTOR
FLUORESCENT LAMP

COUPLING ELEMENTS
KE1
KE2
Rk
Ls
Cs
R2
R3
Uzw.
Un
SUMMING ELEMENT
SW
HMG
RAG
SR
IW
RR
REGULATOR
WR
FLUORSCENT LAMP
INVERSE RECTIFIER
O
OSCILLATOR
C1
T1
T2
L1
LL
C2
A
B
D
IW
LAMP CURRENT OR POWER DETECTOR
GL
SG
RECTIFIER FILTER

ELECTRONIC BALLAST

BACKGROUND OF THE INVENTION

1. Field of the Invention

The present invention relates to an electronic ballast and is particularly concerned with such a ballast which comprises an inverter rectifier constructed in a switching bridge and to whose output side at least one load circuit composed of the series circuit of a lamp inductor with the parallel circuit composed of an ignition capacitor and a fluorescent lamp is connected. A regulator acting on the control of the switches of the first rectifier stabilizes the light current of the fluorescent lamp dependent on the lamp power or on the lamp current on the basis of a comparison between a reference value and a measured value derived from the lamp power or the lamp current and, simultaneously, enables a brightness regulation of the fluorescent lamp within broad limits dependent on the reference value which is a variable reference value.

2. Description of the Prior Art

Electronic ballasts of the type generally set forth above are disclosed, for example, by the German patent 37 09 004 A1. When such an electronic ballast is to be employed for dimming a fluorescent lamp within broad limits, particular difficulties arise given the settings <10% of the nominal lighting current. Fluorescent lamps have great tolerances with respect to their electrical properties, sensitively react to temperature changes and are subjected to aging phenomena. When dimming the fluorescent lamp to low values, there is therefore the risk that the fluorescent lamp will go out because the discharge is interrupted.

In the aforementioned reference, the regulator regulates the brightness of the fluorescent lamp via its discharge current. This principle, however, fails given the settings <10% of the nominal lighting current, since the differential current transformer needed for this purpose would have to be completely free of stray field. In the dimmed position of 1%, a stray field of the differential current transformer of only 1% of the main flow would falsify the measured result by approximately 100%.

As disclosed, for example, in the German patent 25 44 364 A1, the regulation can also occur via the lamp power instead of by way of regulating the discharge current of the fluorescent lamp. This, however, has the disadvantage that only the sum of lamp power and helices heating capacity can be regulated. The helices heating capacity is greatly dependent on the tolerance-affect helices resistance. This type of regulating can therefore only be conditionally employed given dimmed setting <10% of the nominal light power. In a dimmed position of 1% of the nominal light power, for example, the light power to be regulated in standard fluorescent lamps amounts to about 0.5 W, but the heating capacity amounts to approximately 4 W. A satisfactory synchronism between a plurality of fluorescent lamps can thus not be guaranteed in this manner given the positions <10%.

SUMMARY OF THE INVENTION

It is an object of the present invention to provide, in a dimmable electronic ballast, whether a discharge current regulation or a power regulation of the fluorescent lamp is used, structure for enabling a reliable dimming with little added expense, even given dimmed settings below 10% of the nominal lighting current down to less than 1%.

The above object is achieved, according to the present invention, in an electronic ballast comprising an inverter rectifier in a switching bridge construction whose output side is connected to at least one load circuit composed of the series circuit of a lamp inductor with the parallel circuit of an ignition capacitor and a fluorescent lamp, a regulator acting on the control of the switches of the inverter rectifier stabilizes the brightness of the fluorescent lamp dependent on the lamp power or on the lamp current on the basis of a comparison between a reference quantity and a measure quantity derived from the lamp power or from the lamp current and, simultaneously, enables a brightness regulation of the fluorescent lamp within broad limits dependent on the reference value that is variable in size, and is particularly characterized in that the repetitive error resulting from the reference/actual value comparison has at least one auxiliary controlled variable superimposed thereon that only takes effect at the lower limit of the range of brightness control of the fluorescent lamp and, to this end, is derived either from the D.C. voltage at the electrode of the fluorescent lamp that is not connected to the lamp inductor or, on the other hand, is derived from its maintaining A.C. voltage.

The invention is based on the perception that is principally the discharge current that changes when dimming a fluorescent lamp, whereas the maintaining voltage remains the same, at least seen in terms of the order of magnitude. This means that the voltage-to-current ratio, i.e. the resistance of the discharge path, becomes greater and greater given decreasing brightness of the fluorescent lamp and, ultimately, tends toward infinite when the discharge aborts.

Regardless of what regulation of the fluorescent lamp is used, a fluorescent lamp can therefore still be reliably operated at 1% of its nominal lighting current when the discharge resistance is additionally monitored and the controlled variable derived therefrom is used for the purpose of correcting the actuating variable for the regulator in the lower range of the brightness regulation.

This additional regulation, dependent on the discharge resistance of the fluorescent lamp, has considerable advantages in addition to the foregoing. As has been shown, argon lamps and krypton lamps of the same length that otherwise exhibit different electrical properties have approximately the same discharge resistance at dimmed settings around 1% of the nominal lighting current. An adaptation of this specific regulation dependent on the lamp type is therefore not required.

A further advantage of this regulation which is dependent on the discharge resistance is comprised in that the ballast can recognize whether the lamp is burning without requiring optoelectronic devices or a differential current transformer to acquire the lamp current for this purpose. This, for example, can be used for controlling the preheating phase of the fluorescent lamp given electronic ballasts provided for warm start since a premature ignition of the fluorescent lamp can be recognized and an immediate switch from preheating to operation can be undertaken.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
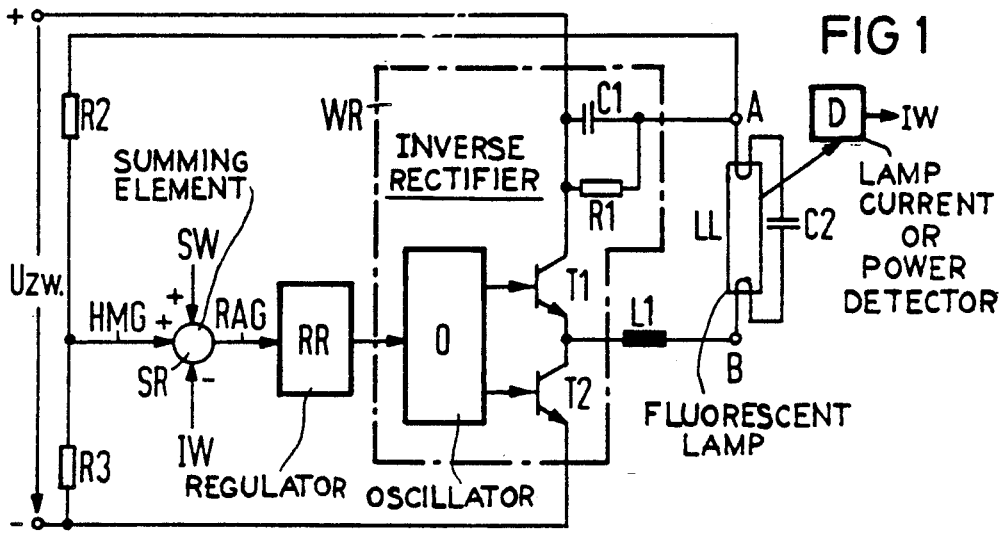
FIG. 1 is a schematic circuit diagram of a first exemplary embodiment of an electronic ballast which is dimmable within broad limits, whereby the auxiliary controlled variable that is dependent on the discharge resistance of the fluorescent lamp is acquired from the potential of a lamp electrode.

Referring to FIG. 1, a partially block, partially detail schematic circuit diagram of a dimmable electronic ballast is illustrated as being essentially composed of an inverter rectifier WR whose output side is connected to the load circuit. The load circuit comprises the series circuit of a lamp inductor L1 and a fluorescent lamp LL connected in parallel to an ignition capacitor C2. The inverter rectifier WR employs a half-bridge circuit of two series-connected switches in the form of a pair of transistors T1 and T2 representing power transistors and a half-bridge capacitor C1 to which a discharge resistor R1 is connected in parallel.

The common junction of the half-bridge capacitor C1, the discharge electrode R1 and the upper electrode of the fluorescent lamp LL is referenced A and the junction of the lower electrode with the lamp inductor L1 is referenced B. The switches (transistors) T1 and T2 of the half-bridge circuit are driven by an oscillator O that is, in turn, connected via its control inputs to the output of a regulator RR.

The control of the regulator RR is preceded by a summing element SR having comparator properties and to whose three inputs a reference value SW, an actual value IW and an auxiliary control variable HMG are supplied. The additions of the reference value SW and the auxiliary controlled variable HMG in proper operational sign yield the respective error RAG that is supplied from the output of the summing element SR to the control input of the regulator RR. In the exemplary embodiment of FIG. 1, the reference value SW, the actual value IW and the auxiliary controlled variable HMG are D.C. voltages that together yield the repetitive error RAG that likewise represents a D.C. voltage.

The power supply for the inverter rectifier WR usually occurs in the form of a D.C. voltage that is acquired from the A.C. line and the same is indicated in FIG. 1 as an intermediate circuit D.C. voltage Uzw. This intermediate circuit D.C. voltage is applied at the series circuit of the two switches T1 and T2. The half-bridge capacitor C1 and the discharge resistor R1 are, in turn, connected to the positive pole of the intermediate circuit D.C. voltage Uzw. The auxiliary control variable HMG is taken at the tap of a voltage divider R2/R3 composed of the resistor R2 and R3 that is, in turn, connected from the junction A to the negative pole of the intermediate circuit D.C. voltage Uzw.

The reference value SW that represents a reference voltage is usually generated from a D.C. voltage that is variable in magnitude and that is not illustrated in FIG. 1 or on the other figures. The actual value IW that likewise represents a D.C. voltage is proportional either to the discharge current flowing through the fluorescent lamp LL or, on the other hand, to the lamp power. It can be acquired in a known manner via a differential current transformer or, respectively, via a current-voltage measurement in the region of the load circuit. The circuit-oriented illustration of such an actual value recognition has likewise been omitted in FIG. 1 as well as in the other figures in that the same is well within the knowledge of those of ordinary skill in the art and the same has only been shown by the symbol D.

Given the usually symmetrical drive of the switches T1 and T2 of the half-bridge circuit, half the intermediate circuit DC voltage Uzw superposed by the maintaining A.C. voltage of the fluorescent lamp LL is established at the junction B when the fluorescent lamp LL is illuminated. The half-bridge capacitor C1, as well as the discharge resistor R1 lying parallel thereto, are usually of such sizes that half the intermediate circuit voltage Uzw likewise arises at the junction A given the nominal lighting current of the fluorescent lamp. In other words, the discharge resistor R1 is significantly larger than the discharge resistor of the fluorescent lamp in this operating condition, so that the discharge of the half-bridge capacitor C1 effected by the discharge resistor R1 can be practically neglected. The high-frequency lamp current effects only a slight voltage drop at the half-bridge capacitor C1.

When, proceeding from the nominal lighting current, the fluorescent lamp is then dimmed to decreasing brightness, namely down to the point at which the discharge threatens to abort, then the discharge resistance of the fluorescent lamp LL becomes so large that the discharge resistor R1 can partially discharge the half-bridge capacitor C1. As a result thereof, however, the potential rises at the junction A and the auxiliary controlled variable HMG divided down via the voltage divider R2/R3 changes in the positive direction at the tap of the voltage divider. The auxiliary controlled variable HMG therefore opposes a further lowering of the lamp power and prevents the undesired aborting of the discharge via the regulator R. The described change of the auxiliary controlled variable HMG only has a noticeable affect in the immediate proximity of the lower limit of the range of control of the brightness of the fluorescent lamp LL because it is only in this region that the potential at the junction A rises noticeably.

Figure 2:
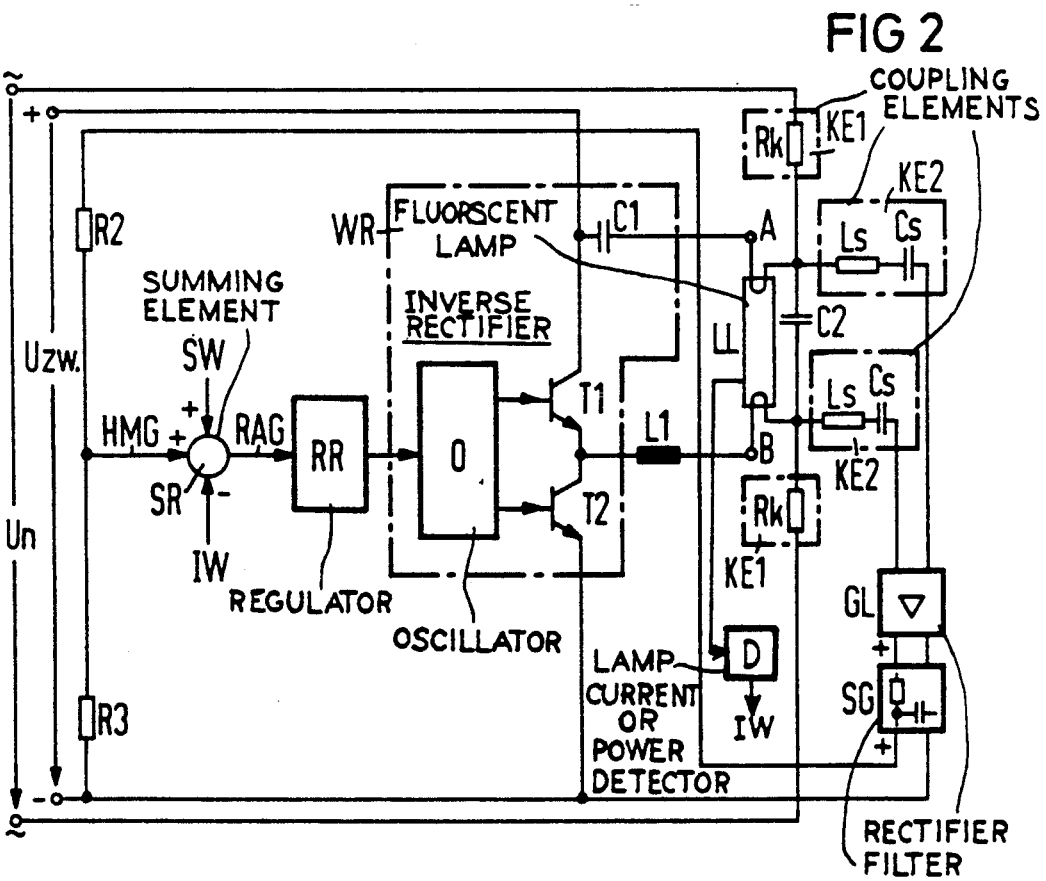
FIG. 2 is a schematic circuit diagram of a second, preferred exemplary embodiment of an electronic ballast which is dimmable within broad limits, whereby the auxiliary controlled variable that is dependent on the discharge resistance of the fluorescent lamp is acquired from a low-frequency portion of the maintaining A.C. voltage of the fluorescent lamp.

The manner of deriving the auxiliary controlled variable HMG from the magnitude of the discharge resistance of the fluorescent lamp LL on the basis of a measurement of a D.C. voltage assumes that no rectifier effects that are inherently possible occur in the fluorescent lamp. For example, such a rectifier effect can occur when great differences are present in the emission capability of the electrodes of the fluorescent lamp LL. When the dependency of the measurement of the D.C. voltage and, therefore, the generation of the auxiliary control variable HMG on such a rectifier effect is to be suppressed, then the auxiliary control variable HMB can also be derived from an alternating voltage. FIG. 2 illustrates a corresponding exemplary embodiment.

The derivation of the auxiliary controlled variable HMG advantageously occurs on the basis of superimposing a low-frequency alternating voltage that is taken at the fluorescent lamp LL. To this end, the fluorescent lamp LL is additionally connected to the A.C. voltage Un via coupling elements KE1, for example in the form of coupling resistors Rk. The low-frequency AC maintaining voltage thereby arising at the fluorescent lamp LL is then supplied to a rectifier GL via further coupling elements KE2 that block the high-frequency portion of the A.C. maintaining voltage as well as the D.C. portion thereof, the rectifier GL being followed by a filter SG for smoothing the rectified, low-frequency portion of the A.C. maintaining voltage. The voltage divider R2/R3, as already illustrated in FIG. 1, and at whose tap the auxiliary controlled variable HMG is available, is connected parallel to the output of the filter SG. The coupling elements KE2 are advantageously composed of the series circuit of the filter choke Ls and a filter capacitor Cs.

Figure 3:
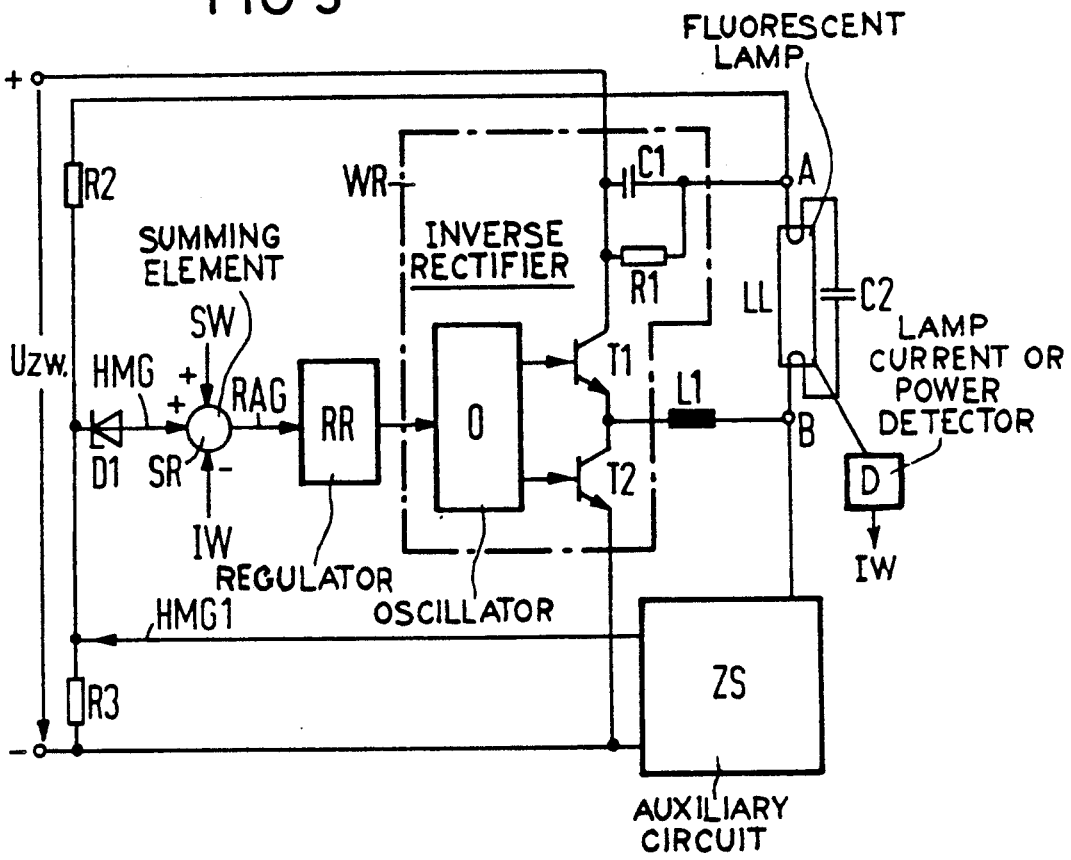
FIG. 3 is a schematic circuit diagram of a modified version of the embodiment illustrated in FIG. 1.

Since the effectiveness of the auxiliary controlled variable HMG is only of interest at the lower limit of the range of brightness control of the fluorescent lamp LL, a threshold device in the form of a Zener diode D1, for example, can be additionally integrated into the connecting path of the tap of the voltage divider R2/R3 to the summing element SR, as illustrated in FIG. 3. The auxiliary regulation that prevents the aborting of the discharge is suddenly activated only when the auxiliary controlled variable HMG at the tap of the voltage divider R2/R3, given a dimmed setting of, for example, 1% or 2% of the nominal lighting current, has become so great, then the Zener diode becomes conductive and is in its low-resistance state. The behavior of the regulator in the range of brightness control above this threshold is then not influenced by this auxiliary regulation in what is definitely a desirable fashion. The Zener diode D1 is entered in the circuit diagram of FIG. 3, FIG. 3 representing a development of the circuit of FIG. 1. Apart from the Zener diode D1 in the connecting path of the tap of the voltage divider R2/R3 to the summing element SR, the circuit of FIG. 3 differs from the circuit of FIG. 1 on the basis of the auxiliary circuit ZS. A further auxiliary controlled variable HMG1 that is superimposed on the auxiliary controlled variable HMG in an equally-acting manner is generated by way of the auxiliary circuit ZS. As a result thereof, the regulating speed of the addition regulation is significantly improved.

The change of the discharge resistance, given a dimming event of the fluorescent lamp in the direction toward decreasing brightness, results in a relatively slow change of the potential at the junction A since the great time constant of the half-bridge capacitor C1 and of the discharge resistor R1 is prescribed by the overall circuit. Hunting can therefore occur given unfavorable dimensioning. The dynamic behavior of the regulator, however, can be significantly improved by the auxiliary circuit ZS because the influence of this great time constant can be diminished as a result thereof. Given a greatly-reduced lamp power to values below 10% of the nominal power, the A.C. maintaining voltage of the fluorescent lamp decreases together with the lamp power. The auxiliary circuit ZS exploits this condition in that it generates a D.C. voltage from the A.C. maintaining voltage that is proportional to the A.C. maintaining voltage and is superimposed with correct operational sign on the auxiliary controlled variable HMG as a further auxiliary controlled variable HMG1 for the purpose of the desired regulation.

Figure 4:
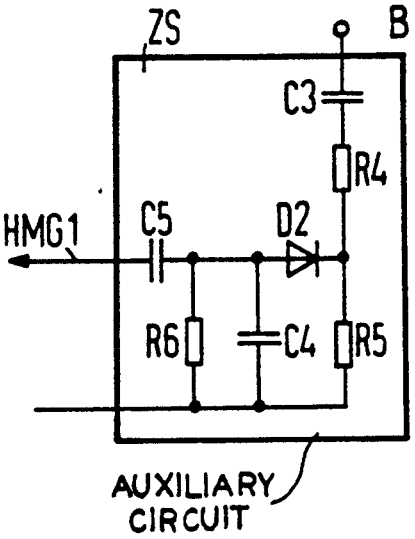
FIG. 4 is a schematic circuit diagram of an embodiment of an auxiliary circuit employed in the electronic ballast of FIG. 3.

A preferred embodiment of the auxiliary circuit ZS of FIG. 3 is illustrated in FIG. 4. Between the junction B and the negative pole of the intermediate circuit D.C. voltage Uzw, it is composed of a series circuit of a capacitor C3 and a voltage divider R4/R5 composed of a pair of resistors R4 and R5. That part of the maintaining AC voltage divided down at the resistor R5 is then rectified via a diode D2 and the rectified AC maintaining voltage is supplied to the parallel circuit composed of a capacitor C4 and a resistor R6. The change of the rectified AC maintaining voltage at the capacitor C4 is then supplied via a capacitor C5 to the resistor R3 of the voltage divider R2/R3 as a further auxiliary controlled variable HMG1.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An electronic ballast for a fluorescent lamp having an A.C. maintaining voltage thereacross, comprising:

a capacitor connected in parallel with the fluorescent lamp;

a lamp inductor connected in series with the fluorescent lamp;

a D.C. voltage supply including first and second poles;

an inverter rectifier including a control input, and an output connected to said series circuit of said lamp inductor and said parallel-connected fluorescent lamp and capacitor, said inverter rectifier including switch means connected to said output and connected to said first and second poles of said D.C. voltage supply;

a regulator including an error input, and an output connected to said control input of said inverter rectifier; and error means connected to the fluorescent lamp and to said error input of said regulator and operable in response to a predetermined lamp operating parameter to compare the value of that parameter with a reference value to produce an error signal for controlling said inverter rectifier via said regulator to stabilize the brightness of the fluorescent lamp, including means for producing at least one auxiliary controlled variable value and superposing the same so that the error signal resulting from the comparison of said lamp operating parameter with said reference value only takes effect of said auxiliary controlled variable value at the lower limit of the range of brightness control of the fluorescent lamp.

2. The electronic ballast of claim 1, wherein:

said means for producing at least one auxiliary controlled variable value is connected to the fluorescent lamp for converting a low-frequency portion of its A.C. maintaining voltage into a D.C. value.

3. The electronic ballast of claim 1, wherein said error means comprises:

measuring means connected to the fluorescent lamp for producing a D.C. voltage as a measured actual value of the predetermined lamp operating parameter;

auxiliary means connected to the fluorescent lamp for deriving a D.C. voltage representing the at least one auxiliary controlled variable value;

a reference D.C. voltage value source; and a summing element in said error means connected to said error input of said regulator, to said measuring means, to said auxiliary means and to said referenced D.C. voltage source for adding the D.C. voltages thereof to form a repetitive error signal and apply the same to said error input of said regulator.

4. The electronic ballast of claim 3, wherein:

said switch means comprises first and second serially-connected switches;

a half-bridge capacitor is connected between the lamp, at the side thereof not connected to said lamp inductor, and said first pole of said D.C. voltage supply;

a discharge resistor is connected in parallel with said half-bridge capacitor;

said error means comprises a voltage divider including a tap, said voltage divider connected between the junction of said half-bridge capacitor and said discharge resistor with the fluorescent lamp and said second pole of said D.C. voltage supply, said summing element including a first input connected to said tab to receive said at least one auxiliary controlled variable value.

5. The electronic ballast of claim 4, wherein:

said discharge resistor has a value on the order of magnitude of the discharge resistance of the fluorescence lamp at the lower end of its range of brightness.

6. The electronic ballast of claim 5, and further comprising:

first and second A.C. voltage supply terminals for providing the A.C. maintaining voltage;

decoupling elements for acquiring the auxiliary control variable value, each of said decoupling elements connected between a respective A.C. voltage supply terminal and the fluorescent lamp to pass a low-frequency portion of the A.C. maintaining voltage;

coupling elements connected to the junctions of said decoupling elements with the fluorescent lamp to block a high-frequency portion of the A.C. maintaining voltage;

a rectifier connected to said coupling elements; and a smoothing filter connected to said rectifier to provide said auxiliary controlled variable value.

7. The electronic ballast of claim 4, and further comprising:

an auxiliary circuit including an output connected to said tap of said voltage divider, said auxiliary circuit connected between said second pole of said D.C. voltage supply and the junction of said lamp inductor and the fluorescent lamp and operable in response to the A.C. maintaining voltage of the fluorescent lamp to produce a further auxiliary controlled variable value for magnifying the effect of the at least one auxiliary controlled variable value in the internal range of brightness regulation.

8. The electronic ballast of claim 7, wherein:

said auxiliary circuit comprises a parallel circuit, including a further resistor and a further capacitor, connected to said second terminal of said D.C. voltage supply, a series circuit including another capacitor and another resistor connected to the junction of said lamp inductor and the fluorescent lamp, a diode connected between said series circuit and said parallel circuit, and a coupling capacitor connected between the junction of said parallel circuit with said diode and said output of said auxiliary circuit, said auxiliary circuit rectifying and smoothing a portion of the A.C. maintaining voltage to provide said further auxiliary controlled variable value.

9. The electronic ballast of claim 7, and further comprising:

threshold means connected between said tap of said voltage divider and the corresponding input to said summing element for providing a threshold on the actuating quantity of said regulator that results from the actual/reference value comparison.

* * * * *